US006406408B1

(12) United States Patent
Price, II

(10) Patent No.: US 6,406,408 B1
(45) Date of Patent: Jun. 18, 2002

(54) EXERCISE GAME SYSTEM

(76) Inventor: Bill Price, II, 2112 W. Ridge Center, Morehead City, NC (US) 28557

( * ) Notice: Subject to any disclaimer, the term of this patent is extended or adjusted under 35 U.S.C. 154(b) by 0 days.

(21) Appl. No.: 09/461,631

(22) Filed: Dec. 13, 1999

Related U.S. Application Data

(62) Division of application No. 08/871,198, filed on Jun. 9, 1997, now Pat. No. 6,090,019, which is a division of application No. 08/296,152, filed on Aug. 25, 1994, now Pat. No. 5,637,061, which is a continuation of application No. 07/781,364, filed on Oct. 23, 1991, now Pat. No. 5,366,427.

(51) Int. Cl.[7] ..... A63B 21/00

(52) U.S. Cl. ..... 482/92; 482/93; 482/148; 434/252

(58) Field of Search ..... 482/121, 92, 148, 482/93, 123, 130, 122, 129

(56) References Cited

U.S. PATENT DOCUMENTS 1,732,574 A 10/1929 Brown et al.
2,072,723 A 3/1937 Stitt
2,192,096 A 2/1940 Minger
2,455,707 A 12/1948 Sheffer
2,584,956 A 2/1952 Williams
2,610,055 A 9/1952 Goodyear
2,937,023 A 5/1960 Seymour et al.
3,068,001 A 12/1962 Portman
3,068,002 A 12/1962 Balne
3,068,003 A 12/1962 Portman et al.
3,091,457 A 5/1963 Mentzer et al.
3,091,458 A 5/1963 Becks
3,091,459 A 5/1963 Lindman
3,129,940 A 4/1964 Lauro
3,214,171 A 10/1965 Luchsinger
3,223,413 A 12/1965 Whitney
3,349,621 A 10/1967 Mullen
3,463,494 A * 8/1969 Stroh ..... 482/121
3,672,675 A 6/1972 Morris, Jr.
3,672,679 A 6/1972 Burns
3,707,284 A 12/1972 Waldeck
3,712,621 A 1/1973 Ames
3,966,203 A 6/1976 Bickford
3,979,114 A 9/1976 Codina
3,998,454 A 12/1976 Jones
4,039,183 A 8/1977 Sakurada
4,039,185 A 8/1977 Rhodes
4,039,187 A 8/1977 Shea
4,149,713 A 4/1979 McLeod
4,149,714 A 4/1979 Lambert, Jr.
4,200,279 A 4/1980 Lambert
4,200,280 A 4/1980 Goodwin
4,211,402 A 7/1980 Carroll
4,226,415 A 10/1980 Wright
4,230,317 A 10/1980 Breslow et al.
4,319,747 A 3/1982 Rogers
4,405,128 A 9/1983 McLaughlin et al.
4,411,421 A 10/1983 Hershberger
4,500,089 A 2/1985 Jones
4,627,619 A 12/1986 Rockwell et al.
4,872,679 A 10/1989 Bohaski et al.
5,050,874 A 9/1991 Fitch
5,054,783 A 10/1991 Hull et al.
5,064,196 A 11/1991 Gottlieb
5,078,404 A 1/1992 Barillaro et al.
5,125,882 A 6/1992 La Mothe et al.
5,156,402 A 10/1992 Hart
5,158,299 A 10/1992 Otter
5,242,344 A 9/1993 Hundley

* cited by examiner

*Primary Examiner*—Jerome W. Donnelly
(74) *Attorney, Agent, or Firm*—Finnegan, Henderson, Farabow, Garrett & Dunner, L.L.P.

(57) ABSTRACT

An exercise system for one or more persons including a frame, at least one game element, at least one striking member operable by a person to engage the game element, and a resistance system connected to the striking member for resisting the movement of the striking member as it is operated by the person, whereby the person performs exercise while operating the striking member to exchange the game element.

46 Claims, 15 Drawing Sheets

FIG. 5A
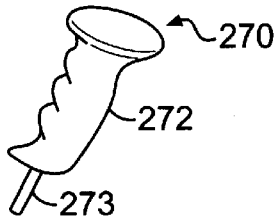
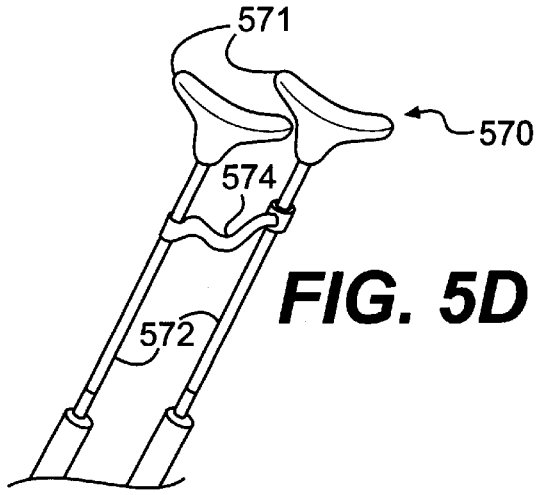
FIG. 5D
FIG. 5B
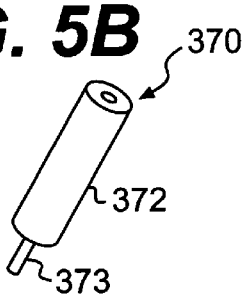
FIG. 5E
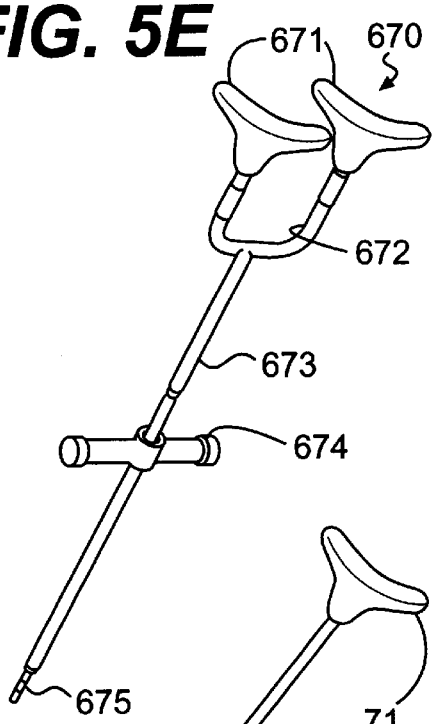
FIG. 5C
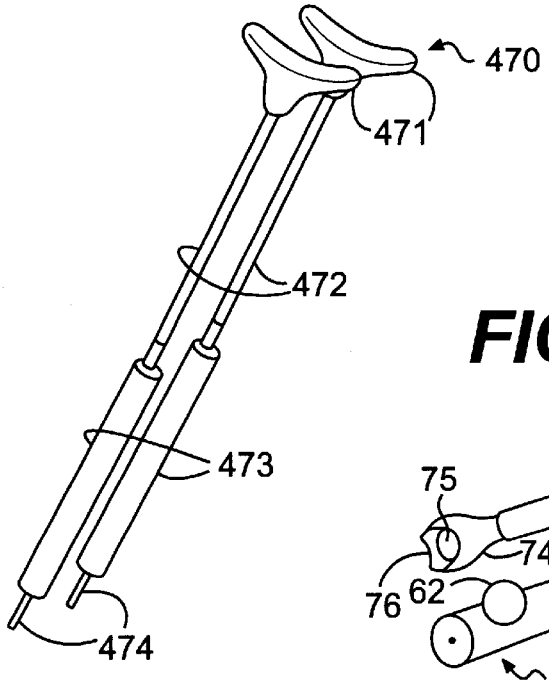
FIG. 5F
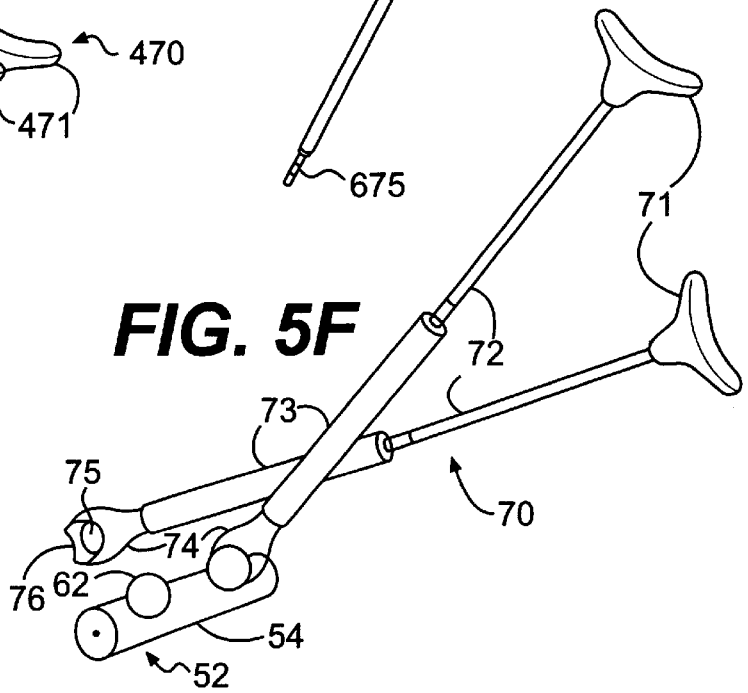

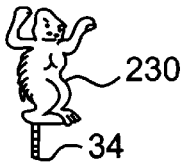
FIG. 10A
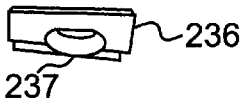
FIG. 11A
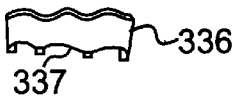
FIG. 11B
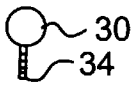
FIG. 10B
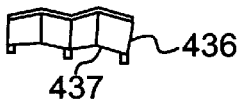
FIG. 11C
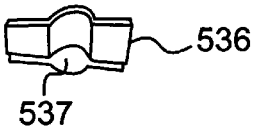
FIG. 11D
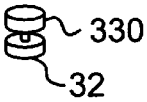
FIG. 10C
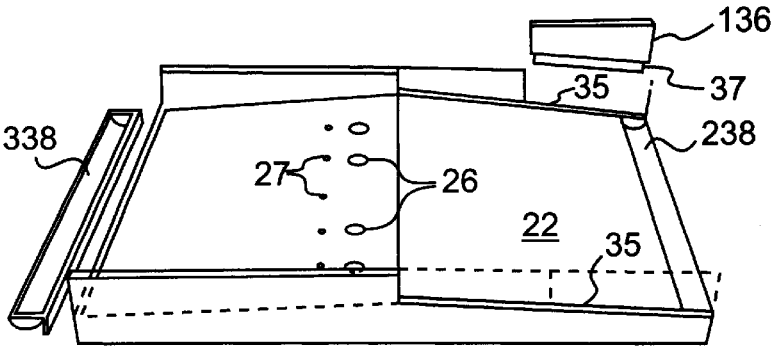
FIG. 12
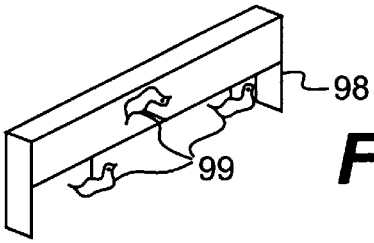
FIG. 13
FIG. 14A
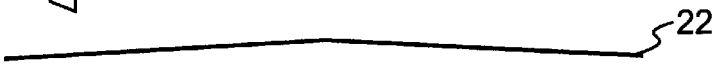
FIG. 14B
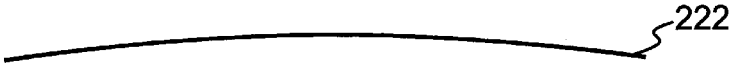
FIG. 14C
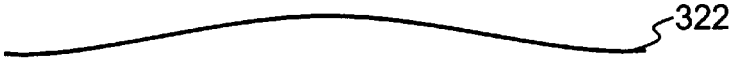
FIG. 14D
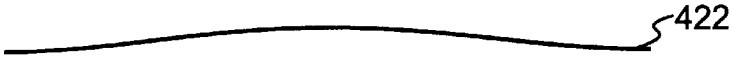
FIG. 14E
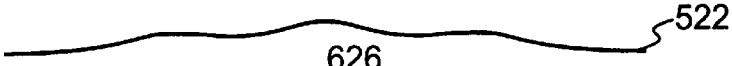
FIG. 14F
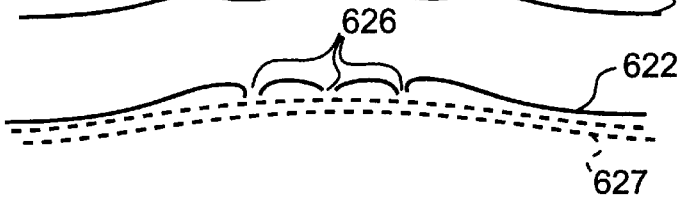

EXERCISE GAME SYSTEM

This is a divisional of application Ser. No. 08/871/198, filed Jun. 9, 1997, now U.S. Pat. No. 6,090,019 which is a divisional of application Ser. No. 08/296,152, filed Aug. 25, 1994, now U.S. Pat. No. 5,637,061, which, in turn, is a Rule 60 continuation of Ser. No. 07/781,364 filed Oct. 23, 1991, now U.S. Pat. No. 5,366,427, all of which are incorporated herein be reference.

BACKGROUND OF THE INVENTION

1. Field of the Invention

The present invention relates to an exercise system that allows one or more persons to play a game while exercising.

2. Description of the Prior Art

Many people have a desire and/or need to exercise in order to achieve better health and/or improve personal appearance. Some typical exercise activities are jogging, weight lifting, use of exercise devices, and participation in sporting activities. The known exercise activities have numerous disadvantages including, but not limited to, those set forth below.

It is often difficult to maintain an exercise regimen due to boredom caused by the activity or time constraints. Although participation in sporting activities is often competitive in nature and, therefore, can decrease any lack of motivation caused by boredom, many sporting activities are played outside and, consequently, are weather sensitive. Furthermore, sporting activities can require expensive public or private facilities, which can result in limited availability. Additionally, there is current concern, especially regarding aerobic exercises, that the jarring impact of certain activities can injure an individual's skeletal/muscular system.

Home exercise devices are also not fully satisfactory. For example, although many people primarily wish to exercise the abdominal and chest muscles, many of the home exercise devices exercise only the leg or arm muscles.

SUMMARY OF THE INVENTION

An object of the present invention is to provide an apparatus that induces a person to exercise.

Another object of the present invention is to provide an apparatus that allows one or more persons to exercise while playing a game.

Another object of the invention is to provide an apparatus that exercises the muscles of the abdomen, the back, the shoulders, the chest, and the arms of one or more persons.

Another object of the invention is to provide a low impact exercise game apparatus that reduces the deleterious effects of jarring type impacts on the players' skeletal/muscular system and keeps the players relatively safe from injury.

Another object of the invention is to provide an exercise game apparatus that can be played in a relatively small space, so that it can be played indoors in an environmental controlled space.

Another object of the invention is to provide an exercise game apparatus that can be readily adjust to accommodate a wide range of anatomical dimensions of individual player (s).

Another object of the invention is to provide an exercise game apparatus that can easily be adjusted to provide varying levels of resistance to the physical movements of the individual player(s), both in order to vary the amount of muscular exercise experienced by a player, and also to provide a means by which to handicap either player so as to allow two people of varying strength and ability an equal opportunity to win the game.

Another object of the invention is to provide an exercise game apparatus that can be played by individuals that have certain physical handicaps.

Another object of the invention is to provide an exercise game apparatus that can be easily disassembled or collapsed in such a way that the apparatus can be stored in a cubic space substantially less than the cubic space necessary to play or practice the game and that is easily movable when disassembled or collapsed.

Another object of the invention is to provide an exercise game that provides for competitive play using equipment that is affordable.

Additional objects and advantages of the invention will be set forth in part in the description which follows, and in part will be obvious from the description, or can be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises an exercise system for one or more persons comprising a frame, at least one game element, at least one striking member operable by a person to engage the game element, and a resistance system connected to the striking member for resisting the movement of the striking member as the striking member is operated by the person to engage the game element, whereby the person performs exercise by overcoming the resistance of the resistance system while operating the striking member to exchange the game element.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

BRIEF DESCRIPTION OF THE DRAWINGS

FIG. 5A is a perspective view of an embodiment of a manipulating device of the present invention.

FIG. 5B is a perspective view of another embodiment of a manipulating device of the present invention.

FIG. 5C is a perspective view of another embodiment of a manipulating device of the present invention.

FIG. 5D is a perspective view of another embodiment of a manipulating device of the present invention.

FIG. 5E is a perspective view of another embodiment of a manipulating device of the present invention.

FIG. 5F is a perspective view of another embodiment of a manipulating device of the present invention.

FIG. 10A is a perspective view of an embodiment of a bumper device of the present invention.

FIG. 10B is a perspective view of another embodiment of a bumper device of the present invention.

FIG. 10C is a perspective view of another embodiment of a bumper device of the present invention.

FIG. 11A is a perspective view of an embodiment of a side panel of the present invention.

FIG. 11B is a perspective view of another embodiment of a side panel of the present invention.

FIG. 11C is a perspective view of another embodiment of a side panel of the present invention.

FIG. 11D is a perspective view of another embodiment of a side panel of the present invention.

FIG. 12 is a perspective view of an embodiment of a playing surface of the present invention.

FIG. 13 is a perspective view of an embodiment of a target display device of the present invention.

FIG. 14A is a section view of an embodiment of a playing surface of the present invention.

FIG. 14B is a section view of another embodiment of a playing surface of the present invention.

FIG. 14C is a section view of another embodiment of a playing surface of the present invention.

FIG. 14D is a section view of another embodiment of a playing surface of the present invention.

FIG. 14E is a section view of another embodiment of a playing surface of the present invention.

FIG. 14F is a section view of another embodiment of a playing surface of the present invention.

DESCRIPTION OF THE PREFERRED EMBODIMENTS

Reference will now be made in detail to the presently preferred embodiments of the invention, examples of which are illustrated in the accompanying drawings. Wherever possible, the same reference numbers will be used throughout the drawings to refer to the same or like parts.

The present invention provides an exercise system that allows one or more persons to play a game while exercising. In accordance with the invention, the present invention includes a frame, game element, a striking member for engaging the game element, and a resistance system connected to the striking member for resisting the movement of the striking member.

The playing area can be designed to accommodate most any type of game. The playing area can have a continuous flat playing surface, a continuous deformed playing surface, two separate playing surfaces, or any type of playing surface necessary to play the desired game. The playing area also can be a general area defined by the frame. For example, the playing area can be an area defined by the frame, in which game elements, such a tethered balls, can move freely. A playing area is not essential to the action of the exercise game, as the striking member can be arranged in such a way as to strike a game element, such as a target, in the immediate vicinity of the striking member.

Figure 1:
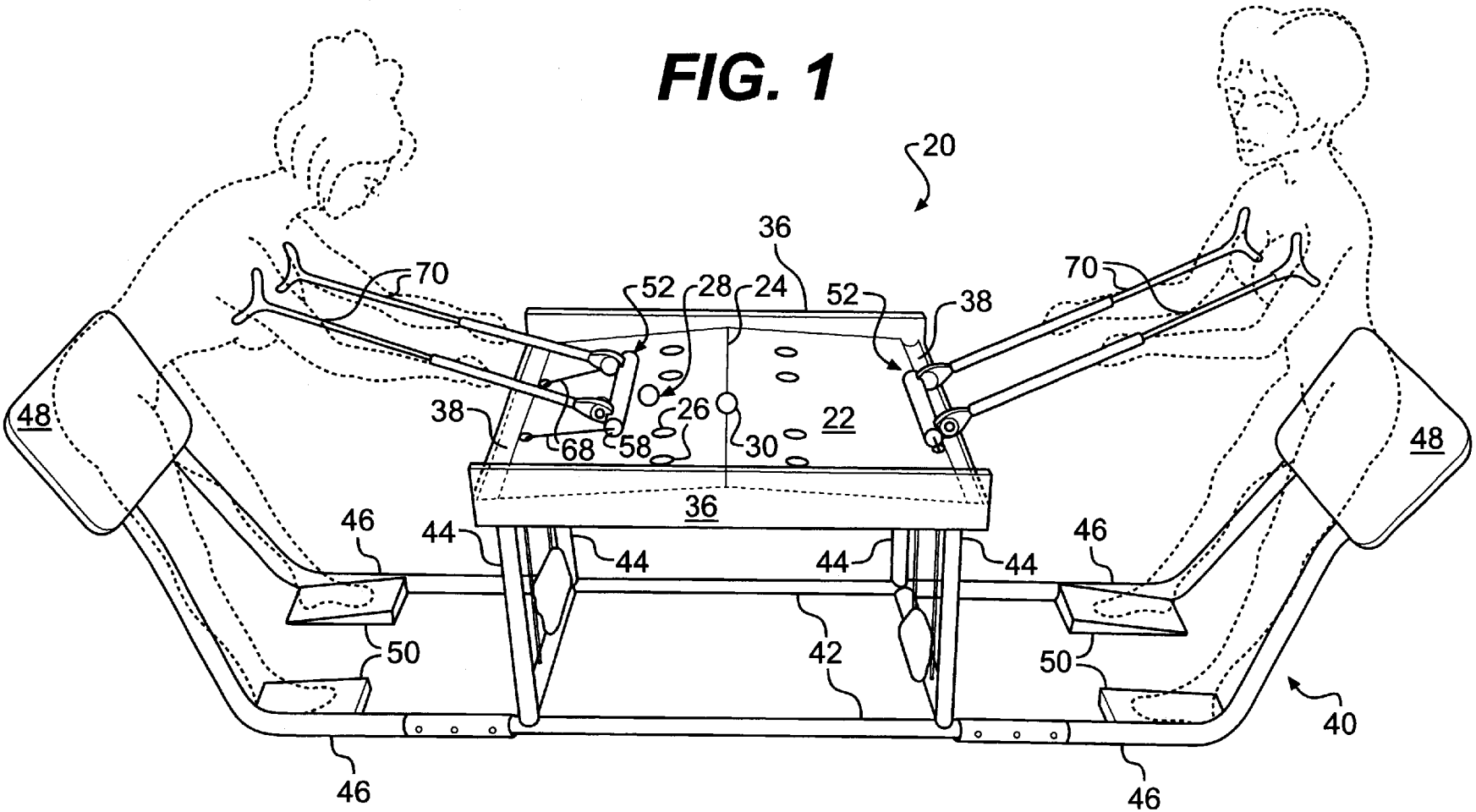
FIG. 1 is a perspective view of an embodiment of the present invention.

A presently preferred embodiment of the exercise system 20 is illustrated in FIG. 1. As shown in FIGS. 1 and 14A, a presently preferred embodiment of the playing area has a continuous playing surface 22, which is inclined on opposing sides of a central ridge 24. The playing surface 22 has a plurality of pockets or holes 26 for receiving one or more of the game elements 28.

FIGS. 14B–14F illustrate a few of the many possible additional configurations of the playing surface. FIG. 14B shows a playing surface 222 having a smooth curve. FIG. 14C shows a playing surface 322 having a curved hump shape. FIG. 14D shows a playing surface 422 having two flat side field areas rising to a horizontal upper surface. FIG. 14E shows a playing surface 522 having a tiered curved surface. FIG. 14F shows a playing surface 622 having a curved surface incorporating depressions 626 leading to holes connected to a ball return 627 formed, for example, from pipes or tubes. As is evident, numerous playing surfaces configurations are possible.

Bumper devices 30 that project into the field of play from above, beneath, or the side of the playing area can also be used to alter the format of the game. The bumper devices 30 can include, for example, plugs or rebound members. Some alternate bumper devices 230 and 330 are illustrated in FIGS. 10A and 10C. The bumper devices 30 can be attached directly to the playing surface 22. Alternatively, the bumper devices 30 can be supported by disks 32 or pins 34, which can be inserted in holes 26 or pinholes 27, respectively, in the playing surface, as shown in FIG. 12. The holes 26 and pinholes 27 can be located at any location on the playing surface 22 as may be required by the desired game.

The ends and sides of the playing area can, for example be unbounded. The playing area can also be bounded on the sides and ends by fixed or removable side panels, gutters, pocket devices, or any conventional means for bounding the edges of a playing area. In the embodiment shown in FIG. 1, the playing area is bounded on the sides by side panels 36 and on the ends by a gutter 38. FIGS. 11A–11D illustrate merely a few of the possible side panels that can be used with the apparatus of the present invention. FIG. 11A shows a side panel 236 having a bumper device 237. FIG. 11B shows a side panel 336 having a curvilinear side surface 337. FIG. 11C shows a side panel 436 having a zigzag side surface 437. FIG. 11D shows a side panel 536 having a pocket 537 into which a game element 28 can be directed to score points.

FIG. 12 illustrates an embodiment of a means for removably attaching side panels 136 to the playing surface 22. Blades 37 are provided on the side panels 136 and a slot 35 is provided on the border of the playing surface 22. The side panels 136 can be positioned by inserting the blades 37 into the slot 35. As also shown in FIG. 12, the ends of the playing surface 22 can be bound by a fixed gutter 238 or detachable gutter 338.

A frame 40 supports the playing area at a predetermined height. Preferably, the frame 40 is formed from steel tube. As shown in FIG. 1, floor base members 42 locate playing area support legs 44, which legs 44 support the playing surface 22 at a height above the floor. The legs 44 can include a conventional means for adjusting the height of the playing surface 22 above the floor base members 42. Seat support members 46 extend horizontally from the ends of floor base members 42 and then bend upwards to provide a support for the seat rest 48 at a position relative to the playing surface 22. The position of the seat rest 48 can be adjusted by telescoping or other conventional adjustments means. Foot rests 50 are attached to seat support members 46 to located and support the players' feet. The position of the foot rests 50 can be adjustable by using conventional means.

Figure 16A:
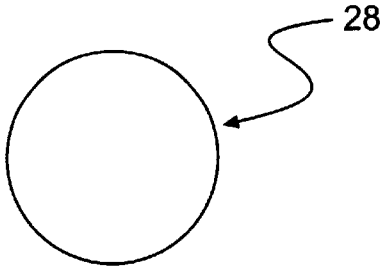
FIG. 16A is a perspective view of an embodiment of a game element of the present invention.
Figure 16B:
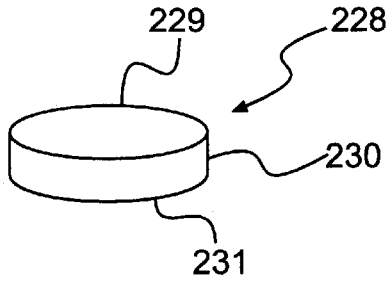
FIG. 16B is a perspective view of another embodiment of a game element of the present invention.
Figure 16D:
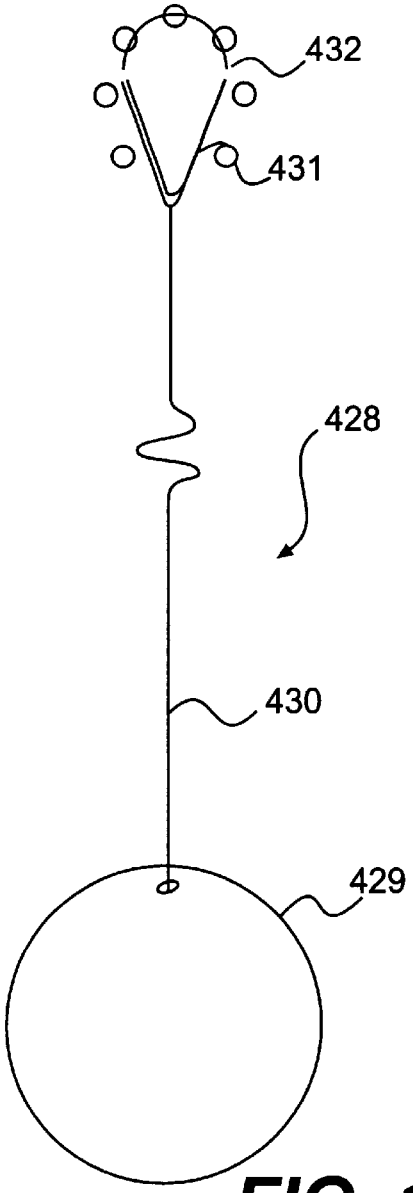
FIG. 16D is a perspective view of another embodiment of a game element of the present invention.
Figure 16C:
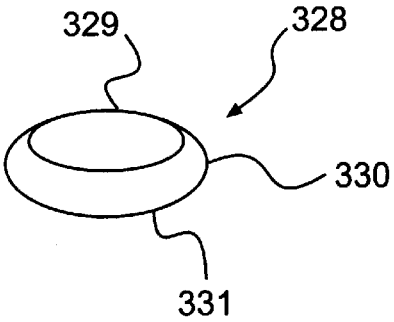
FIG. 16C is a perspective view of another embodiment of a game element of the present invention.
Figure 16E:
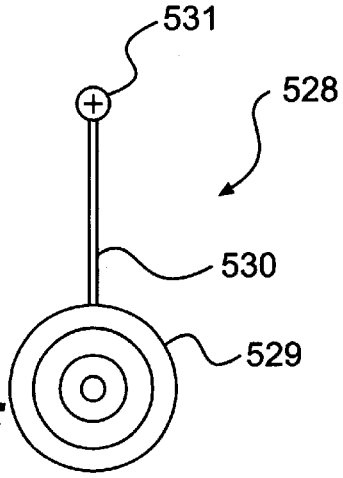
FIG. 16E is a perspective view of another embodiment of a game element of the present invention.

The apparatus of the present invention can also include at least one game element 28 movable within the playing area. As shown in FIGS. 1 and 16A, the presently preferred game element is a spherical ball. FIGS. 16B–16E illustrate a few of the many additional possible varieties of game elements that can be used with the various embodiments of the present invention. FIG. 16B depicts a puck 228. The puck 228 shown in FIG. 16B is a circular disc having a top surface 229, vertical side 230, and bottom surface 231. FIG. 16C depicts a puck 328 with a top surface 329, curved side surface 330, and flat bottom surface 331. FIG. 16D depicts a game element 428, including a sphere 429 attached to a flexible or inflexible, elastic or inelastic tether 430 connected to a support ring 431. The support ring 431 runs through a series of special rollers 432 configured to roll on game element support 153 shown in FIG. 2. FIG. 16E depicts a target assembly 528, which can be the object of a striking action of striking member 52. The target assembly 528 includes target 529, which can be of any configuration, size, shape, or rebound characteristics consistent with the character of the game to be played. The target 529 is movable on pendulum 530 by pivoting on point 531.

As embodied herein, the present invention includes at least one striking member 52 operable by a person to engage the movable game element 28 and move the movable game element 28 to selected positions within the playing area. The striking member 52 can also served as a blocking member to block the path of a game element 28. The striking member 52 can engage the game element 28 by directly contacting the game element 28 or, for example, by having a magnetic field that repels the game element 28.

The striking member can be in a variety of forms or shapes including, but not limited to, a sphere, a cylinder, a square, a rectilinear cube, an octagon, a disc, a pie shaped object, or multi-bulbous shaped object. The striking member can include protruding portions of various shapes. The protruding portions can be integral or separate from the remainder of the striking member.

Figure 4A:
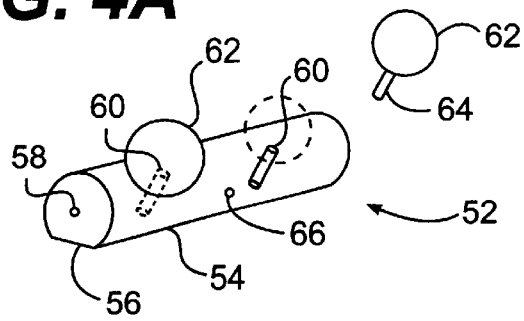
FIG. 4A is a perspective view of an embodiment of a striking member of the present invention.

A preferred embodiment of the striking member 52, as shown in FIGS. 1 and 4A, includes an elongated cylindrical member 54 having a flat bottom surface 56, attachment points 58 on each end for connection to a motion resistance system, two holes 60 angled upward and toward the player, and two protruding portions 62 having pins 64 that are inserted in the holes 60. The protruding portions 62 are each preferably substantially spherically shaped and have a concave surface substantially conforming to the cylindrical shape of the elongated member. An attachment point 66 can also be provided for single line resistance systems.

Figure 4E:
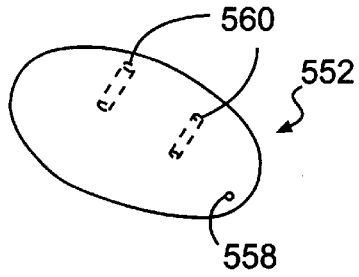
FIG. 4E is a perspective view of another embodiment of a striking member of the present invention.
Figure 4B:
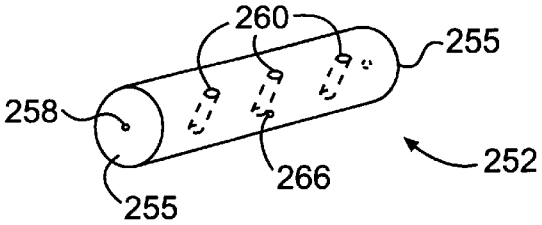
FIG. 4B is a perspective view of another embodiment of a striking member of the present invention.
Figure 4F:
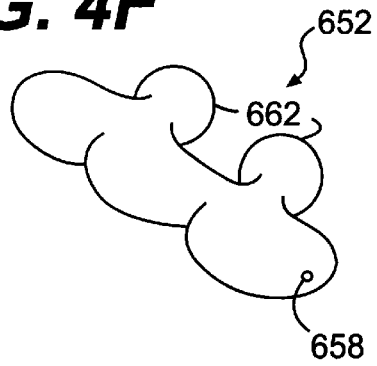
FIG. 4F is a perspective view of another embodiment of a striking member of the present invention.
Figure 4C:
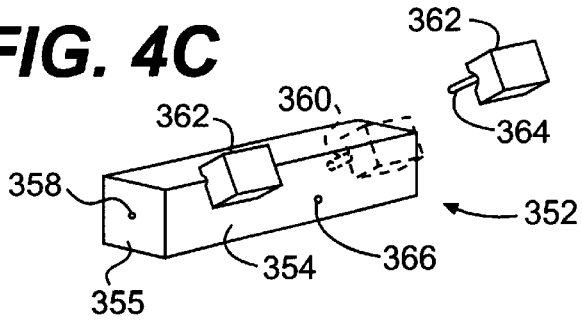
FIG. 4C is a perspective view of another embodiment of a striking member of the present invention.
Figure 4G:
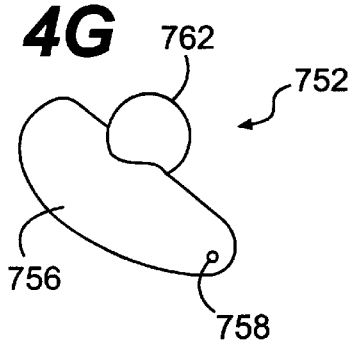
FIG. 4G is a perspective view of another embodiment of a striking member of the present invention.
Figure 4D:
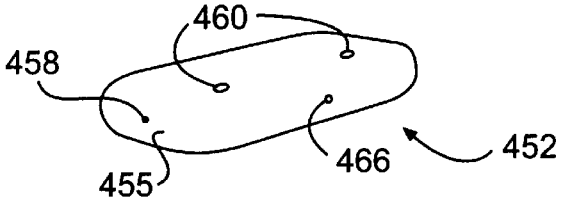
FIG. 4D is a perspective view of another embodiment of a striking member of the present invention.
Figure 4H:
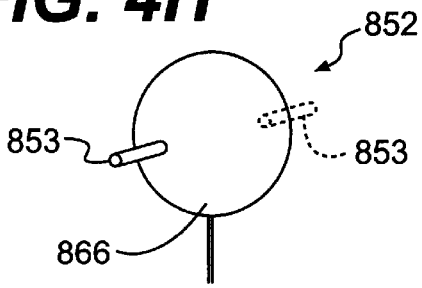
FIG. 4H is a perspective view of another embodiment of a striking member of the present invention.

FIGS. 4B–4H show a few of the many other possible configurations for the striking member. FIG. 4B depicts striking member 252. Striking member 252 is an elongated cylindrical member having ends 255, which ends 255 can be half spherical, flat, or any other shape. Attachment points 258 are located on the ends 255. The striking member 252 also has three pin receiving holes 260. The holes 260 can receive pins from protruding portions or manipulating devices. FIG. 4C depicts a striking member 352 having a rectilinear cubic shaped member 354 with rectangular end surfaces 355. Attachment points 358 are located on ends 355. The striking member 352 also has two pin receiving holes 360 for receiving pins 364 on the protruding portions 362. The striking member 352 also has attachment point 366 for connecting to a single line resistance system. FIG. 4D depicts a rectilinear cube striking member 452 with rounded edges. Attachment points 458 are located on ends 455. The striking member 452 also has two pin receiving holes 460. The striking member also has attachment point 466 for connecting to a single line resistance system. FIG. 4E depicts an oblong striking member 552 having attachment points 558. The striking member 552 has two shaft receiving holes 560. FIG. 4F depicts a multi-bulbous striking member 652 having attachment points 658. The striking member 652 also has protruding portions 662. FIG. 4G depicts a semi-circular striking member 752 with rounded striking surface 756 and attachment points 758. The striking member 752 also has a single protruding portion 762. FIG. 4H illustrates a spherical striking member 852 with shafts 853 projecting from the sides thereof. The striking member also has attachment point 866 for connecting to a single line resistance system.

The striking member is preferably connected to a resistance system by a single line or multiple lines. The striking member can, however, be connected to the resistance system by other means, such as a magnetic system. In the embodiment illustrated in FIG. 1, two lines 68 are attached to attachment points 58 on the striking member 52 and are also attached to the resistance system.

As illustrated in FIG. 1, the invention preferably includes at least two separate striking members 52, each being operable by a different person to move the movable game element within the playing area. As a result, two players can play a competitive game while exercising.

Players can directly grasp the striking member 52, or can utilize manipulating devices 70, to move the striking member 52 to strike or block the game element 28. In the embodiment illustrated in FIG. 1, the player moves the striking member 52 by holding onto two manipulating devices 70 and engaging the striking member 52 with the manipulating devices 70. As illustrated in FIG. 5F, the manipulating devices 70 of a presently preferred embodiment of the invention include end pieces 74 at a first end of the manipulating devices 70 for engaging the striking member 52, shafts 72 extending from the end pieces 74, hand gripping portions 73, and crosspieces 71 at a second end for engaging the body of a player. Preferably, the second end is designed to engage the shoulder joints of a player. Each end piece 74 preferably has concave portions 75 on two side faces and a concave portion 76 on an end face shaped to substantially conform to the shape of the protruding portions 62 and the elongated member 54, respectively.

Preferably, the gripping portions 73 are positioned on the shaft 72 at a predetermined distance from the second end, such that the person is required to extend their arm to a substantially straight position to grip the gripping portions 73. When the arms are fully extended, the person moving the striking member 52 does so by bending at the waist or twisting the torso, as opposed to solely arm movement.

The end pieces 74 of the two manipulating devices 70 can engage either the outer sides or the inner sides of the protruding portions 62 to inhibit rotation of the elongated member 54. Concurrently, concave portions 76 engage the elongated member 54. A person can move the striking member 52 while pressing inwardly on the outer sides of the protruding portions 62 or pressing outwardly on the inner sides of the protruding portions 62. The grasping and manipulation of the striking member 52 with the manipulating devices 70 requires the use of various muscles of the arms, shoulders, and chest of the player. Sufficient force must be applied by the manipulating devices 70 onto the protruding portions 62 and elongated member 54 to prevent the striking member 52 from rotating. If the striking member 52 rotates, the manipulating devices 70 can become disengaged from the striking member 52. If the striking member 52 has a flat bottom surface 56, the flat bottom surface 56 inhibits rotation of the striking member 52, thereby decreasing the amount of force that the person must apply to prevent rotation of the striking member 52. The striking member 52 can also be positioned such that the imposition of force against the striking member 52 by the resistance system urges the protruding portions 62 toward a position that facilitates the grasping of the striking member 52 by the manipulation devices 70.

FIGS. 5A–5E show a few of the many other possible manipulating devices that can be used in the present invention. FIG. 5A illustrates a manipulating device 270 having a handle 272 and a pin 273 that can be inserted in holes 60 of the striking member 52. The pin 273 is sized and shaped to conform with holes 60. Pin connections, as described in this embodiment and the following embodiments, can be slip fit, threaded, spring ball, or any other conventional attachment. FIG. 5B shows a manipulating device 370 having a handle 372 and a pin 373 that can be inserted in holes 60.

FIG. 5C depicts a manipulating device 470 having cross pieces 471, shafts 472, and end pins 474. At least a portion of the shafts 472 are covered with a gripping portion 473. FIG. 5D depicts a manipulating device 570 having shafts 572 connected near the cross pieces 571 by a flexible or rigid crossbar 574 to stabilize and enhance the manipulation characteristics of the manipulating device 570 in order to aid the novice or physically handicapped persons. FIG. 5E depicts a single shaft manipulating device 670 with cross-pieces 671, crosspiece connector 672, shaft 673, hand grips 674, and end pin 675.

Figure 6A:
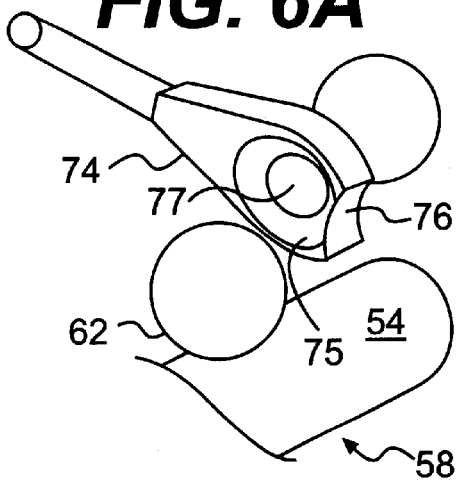
FIG. 6A is a perspective view of an embodiment of an end piece for a manipulating device of the present invention.
Figure 6B:
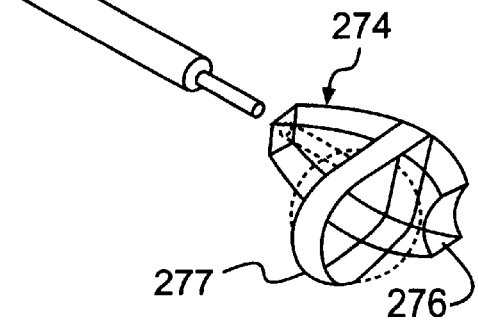
FIG. 6B is a perspective view of another embodiment of an end piece for a manipulating device of the present invention.
Figure 6C:
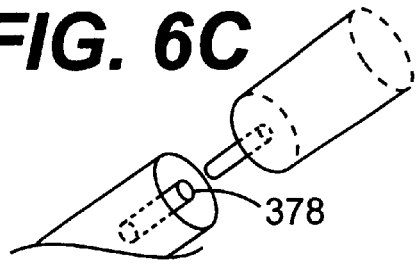
FIG. 6C is a perspective view of another embodiment of an end piece for a manipulating device of the present invention.

FIGS. 6A–6C illustrate end pieces, which can be attached to the manipulating devices and engaged with striking member 52 with varying degrees of removability. FIG. 6A illustrates a presently preferred end piece 74 for the manipulating devices. The end piece 74 can be removably connected to an end pin 474 of the manipulating devices 470 or fixedly directly to an end of a shaft of a manipulating device. End piece 74 features a concave surface 75 on opposing sides, only one concave surface 75 being visible in FIG. 6A. Dependent on the thickness of end piece 74, the concave surfaces 75 can create a hole 77, but hole 77 is not necessary to practice the invention. The concave surface 75 removably engages protruding portions 62 on striking member 52. End piece 74 includes a concave surface 76 that conforms with and engages the elongated member 54 of the striking member 52 while the concave surfaces 75 engage the protruding portions 62.

FIG. 6B depicts an end piece 274 having engagement assistance strap 277 for fixing the end piece 274 of the manipulating device in engagement with the protruding portions 62 on the striking member 52 and thereby maintaining the concave surface 276 in engagement with the elongated member 54 of the striking member 52. The strap 277 can be rigid or flexible.

FIG. 6C depicts a end piece 374 attachable, for example, to manipulating device 470 by inserting end pin 474 into hole 378. The end piece 374 is a solid member having a hole 377 that can fixably or removably engage pins 853 of striking member 852.

As embodied herein, the present invention includes a resistance system that serves as a means for resisting the movement of the striking member as it is operated by the person. The means for resisting the movement of the striking member can utilize suspended weights, elastic materials, springs, hydraulics, gas, or magnetism, or any other motion resistance system.

Figure 7A:
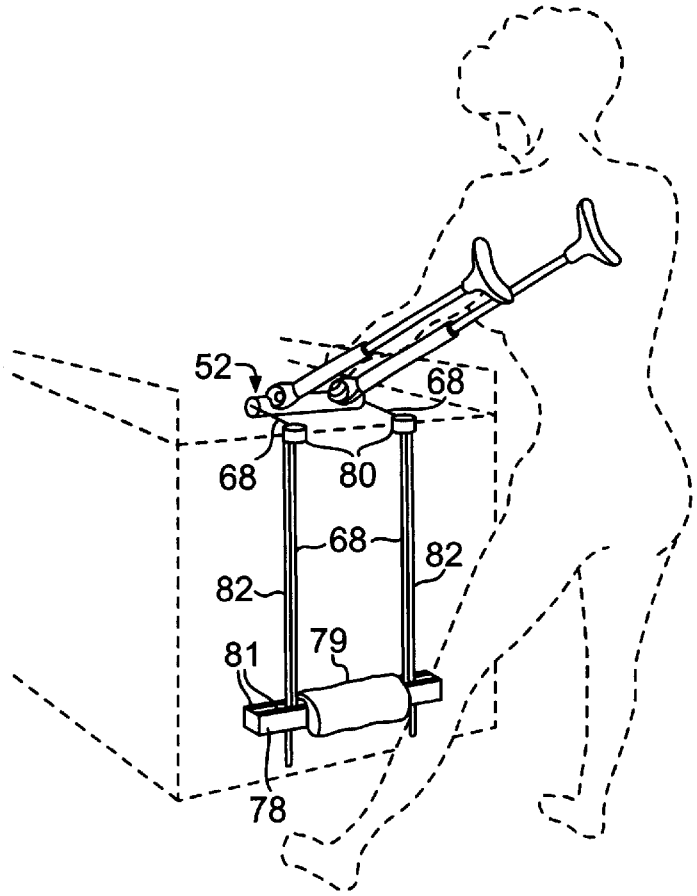
FIG. 7A is a perspective view of an embodiment of a motion resistance system of the present invention.
Figure 8:
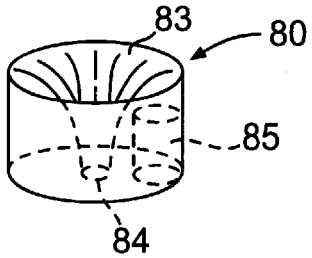
FIG. 8 is a perspective view of an embodiment of a line guide of the present invention.

A presently preferred embodiment of the resistance system is shown in FIGS. 1 and 7A. Preferably, the means for resisting the movement of the striking member includes flexible lines 68 attached to the striking member 52, which lines 68 extend through line guides 80 located at the edge of the playing area; and are connected to weight support bar 78 suspended beneath the playing area. As shown in FIG. 8, line guide 80 comprises a thickened disk having a funnel-shaped line entrance hole 83 on the top, reducing to a line exit hole 84 on the bottom. The line guide 80 includes hole 85 for receiving a weight bar guide shaft 82. The weight support bar 78 includes two flat bars 81 fastened together at the ends thereof and at a central area so as to be capable of sliding up and down on weight bar guide shafts 82. Motion of striking member 52 is resisted by weight 79 placed on the weight support bar 78.

The resistance of the system shown in FIG. 7A can be varied by adding or deleting weight 79 from the weight support bar 78. Therefore, the amount of muscular exertion required to move the striking member 52 can be adjusted.

Figure 7B:
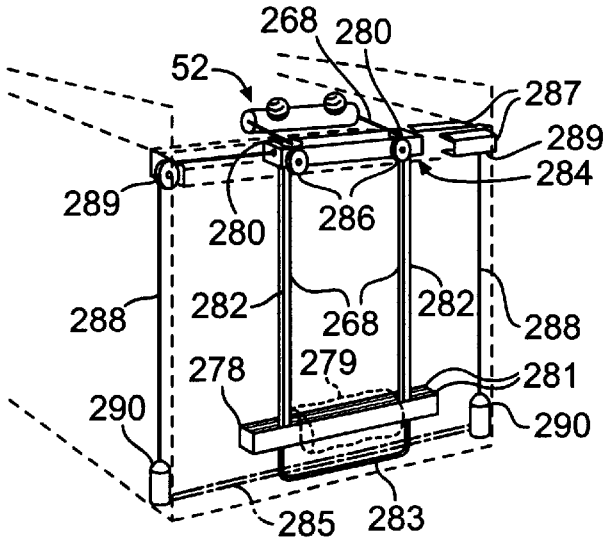
FIG. 7B is a perspective view of another embodiment of a motion resistance system of the present invention.

FIGS. 7B–7E illustrate a few of the many other possible motion resistance systems. FIG. 7B depicts a motion resistance system having two flexible lines 268 affixed to opposite ends of striking member 52, passing through lines guides 280 on carriage 284, and affixed to weight support bar 278. The weight support bar 278 includes two flat bars 281 attached together at the ends thereof and at a central area. The weight support bar 278 is capable of sliding up and down on weight bar guide shafts 282. The weight bar guide shafts 282 are connected at the bottom by connector 283, which can slide in slot 285. Weight 279 is placed on the weight support bar 278 to resist substantially forward motion of striking member 52. Carriage 284 has wheels 286 that roll in channels 287, allowing transverse movement of the carriage 284 along the end of the playing surface. Lines 288 are affixed to opposite ends of the carriage 284, extend around pulleys 289, and connect to transverse weights 290. Transverse movement of carriage 284 is resisted by weights 290, thereby resisting movement of striking member 52. Thus, the amount of resistance to forward and transverse motion of the striking member 52 can be adjusted individually because of the separate resistance systems.

Figure 9:
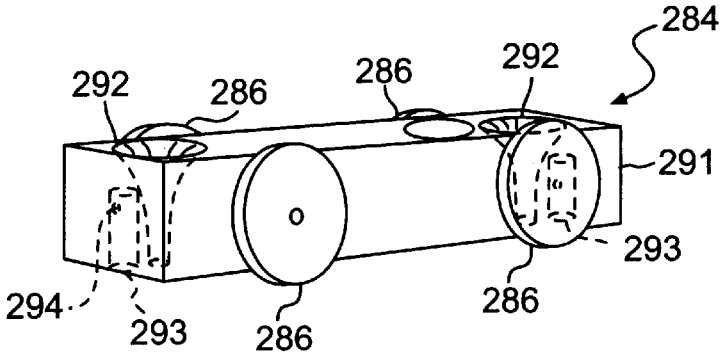
FIG. 9 is a perspective view of an embodiment of a carriage of the present invention.

FIG. 9 provides a larger illustration of carriage 284. Carriage 284 comprises a rectangular cubic body 291, four wheels 286, two funnel-shaped line guide holes 292, weight bar guide shaft holes 293, and transverse line fixing points 294.

Figure 7C:
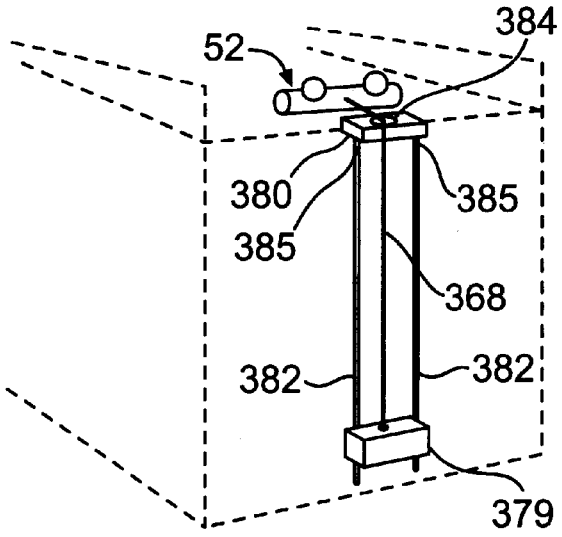
FIG. 7C is a perspective view of another embodiment of a motion resistance system of the present invention.

FIG. 7C depicts a motion resistance system with single line 368 connected to striking member 52. The line 368 runs through line guide 380 and connects to weight 379, which is stabilized by weight guide shafts 382. Additional weights can be placed on weight 379 to increase the resistance of the motion resistance system. Line guide 380 is a rectangular member having a funnel shaped hole 384 and two shaft holes 385 for receiving weight guide shafts 382.

Figure 7D:
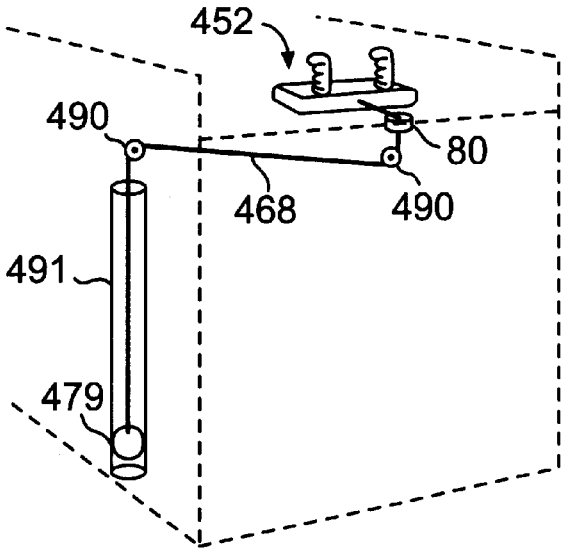
FIG. 7D is a perspective view of another embodiment of a motion resistance system of the present invention.

FIG 7D shows a motion resistance system with a single line 468 connected to a striking member 452. The line 468 runs through line guide 80, around two pulleys 490, and is affixed to weight 479. The weight 479 can be increased or decreased to vary the resistance of the motion of striking member 452. The weight 479 is stabilized by tube 491. The arrangement shown in FIG. 7D is particularly suited for use with the seating arrangement shown in FIG. 15E.

Figure 7E:
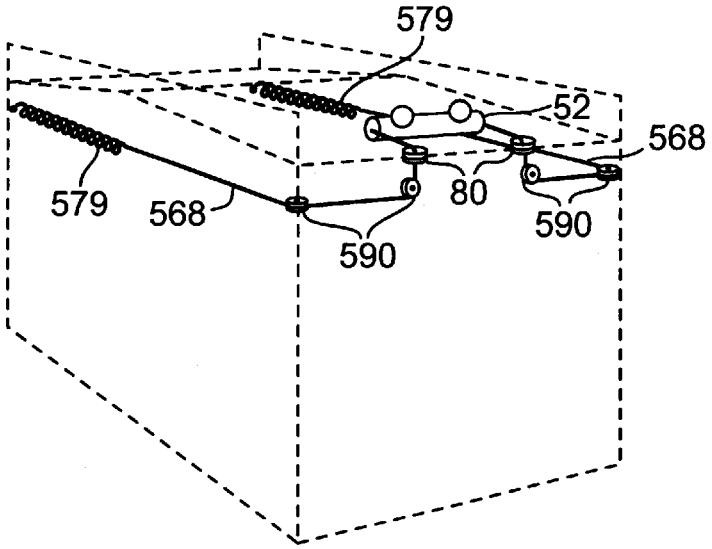
FIG. 7E is a perspective view of another embodiment of a motion resistance system of the present invention.

FIG. 7E illustrates a motion resistance system with lines 568 and 569 connected to a striking member 52. Line 568 runs through line guide 80, around two pulleys 590, and is connected to elastic member 579. Line 569 runs through line guide 80, around two pulleys 590, and is connected to elastic member 579. The elastic members 579 can, for example, be springs. The resistance to the movement of the striking member 52 can be increased by adding more elastic members 579. The elastic members 579 can be combined, alternated, modified or placed in other configurations so as to provide variable resistance to motion of striking member 52.

Depending upon the configuration of the resistance system, the resistance to the movement of the striking member 52 can be varied in response to the direction of movement of the striking member 52, the speed at which the striking member 52 is moved by a person, or the distance of the striking member 52 is moved by a person. The use of various resistance systems is known in the art.

As embodied herein, the means for supporting the players includes means for supporting the buttocks of the person. Foot rests can also be provided to locate and support the players. Preferably, the supporting means is connected to the frame by conventional means. The supporting means, however, can also be independent of the remainder of the exercise game system. The buttocks supporting means is preferably a cushioned seat rest. The seat rest is preferably inclined relative to a plane formed by the playing surface in order to maximize the bending and twisting motion of the person.

Preferably, the seat rests are removable and interchangeable or adjustable by conventional means to accommodate a variety of players anatomical dimensions and physical conditions. The players need not, however, be supported by the seat rest or foot rest to practice the present invention. The seat rest improves, however, the effectiveness of the exercise. The foot rests serve to spread apart the players' feet to provide lateral stability. Additionally, means for restraining the players, such as seat belts or foot straps, can be provided to maintain the players in a proper position.

Figure 15A:
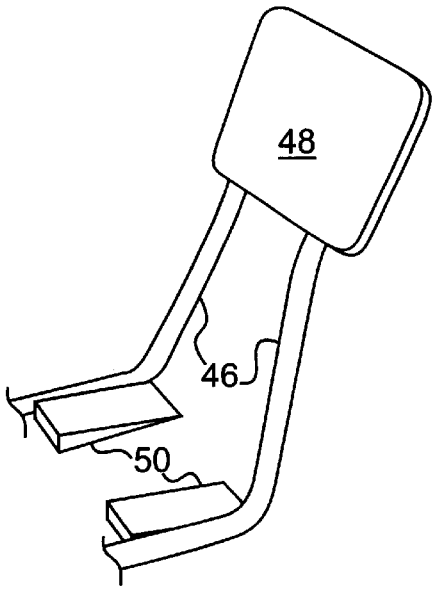
FIG. 15A is a perspective view of an embodiment of a seat and seat support elements of the present invention.

In a preferred embodiment shown in FIGS. 1 and 15A, a generally rectilinear flat seat rest 48 is inclined at an angle away from the playing area. The seat rest 48 can also be vertical, inclined toward the playing area, or movable. FIG. 15A also depicts foot rests 50, which can be connected to the frame at appropriate locations by conventional means. The seat rest 48 is preferably attached to seat support members 46 having a inner diameter larger than the outer diameter of floor base members 42, such that the seat support members 46 can be slid over the floor base members 42. Thus, the seat support members 46 can be positioned at various locations on the floor base members 42 to vary the position of the seat rest 48.

The position of the seat rest 48 relative to the playing area should be established so as to position the player in a posture that requires the player to bend at the waist, push with the shoulders, and twist their torso from side to side in order to manipulate the striking member 52 with the manipulating devices to block, strike, push or hit the game element. Proper positioning allows the player to exercise various muscles of the abdomen, waist, back, and shoulders.

Figure 15B:
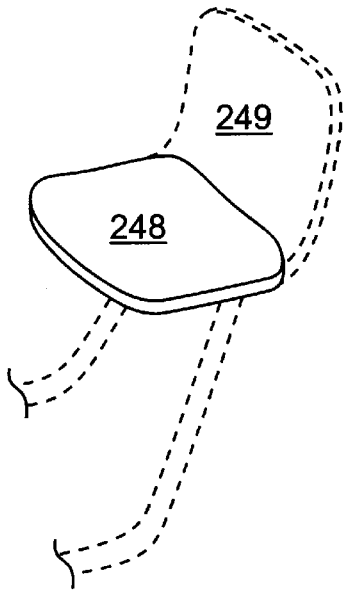
FIG. 15B is a perspective view of another embodiment of a seat and seat support elements of the present invention.
Figure 15C:
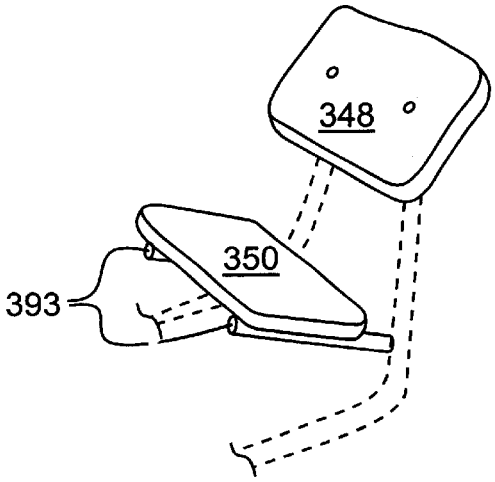
FIG. 15C is a perspective view of another embodiment of a seat and seat support elements of the present invention.
Figure 15D:
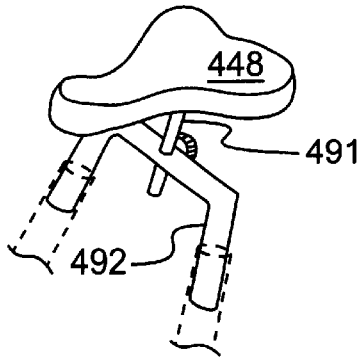
FIG. 15D is a perspective view of another embodiment of a seat and seat support elements of the present invention.
Figure 15E:
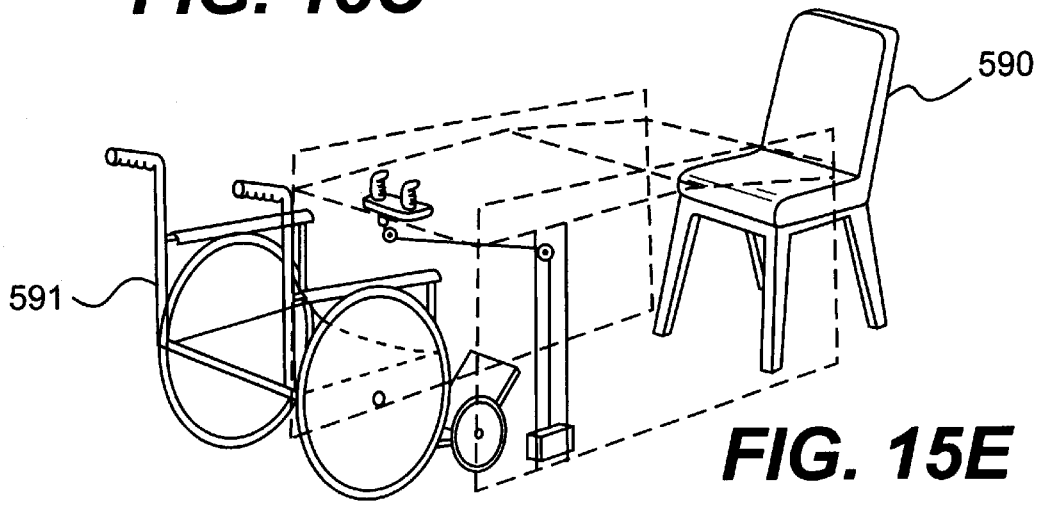
FIG. 15E is a perspective view of another embodiment of a seat and seat support elements of the present invention.

FIGS. 15B–15E illustrate a few of the other possible seat configurations that can be used for the exercise game system of the present invention. FIG. 15B depicts stool or seat rest 248 with an optional back 249, which can be affixed to seat rest 248. FIG. 15C depicts a slanted seat rest 348 with knee rest 350 supported and connected to the frame by braces 393. FIG. 15D depicts a bicycle type seat rest 448 supported by adjustable shaft 491 connected to yoke or crossbar 492. FIG. 15E depicts a frame, in phantom, that is not connected to the seat rests 591, 591. A chair 590 or a wheelchair 591 are provided for supporting players.

Figure 17A:
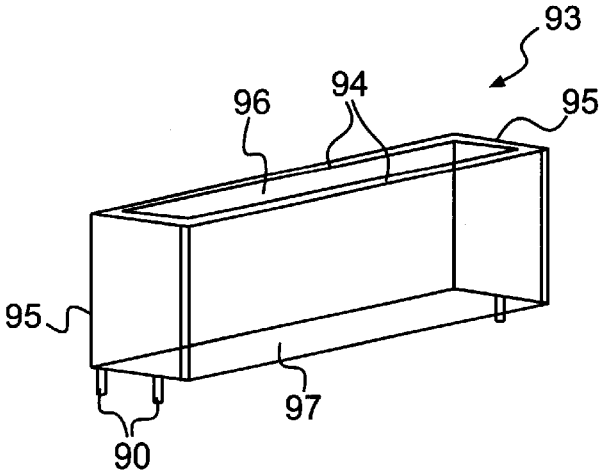
FIG. 17A is a perspective view of an embodiment of a serving device of the present invention.
Figure 17B:
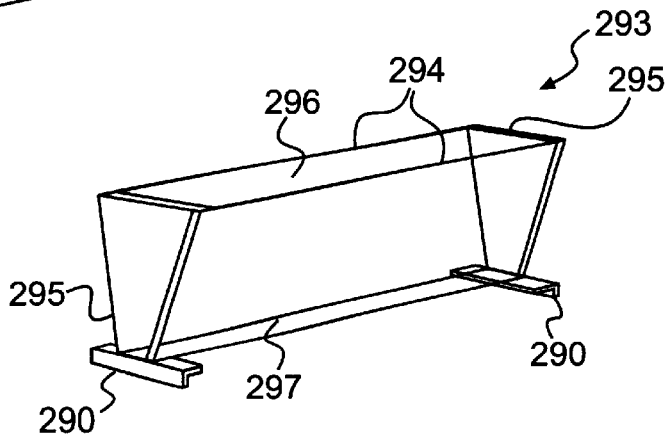
FIG. 17B is a perspective view of another embodiment of a serving device of the present invention.
Figure 17C:
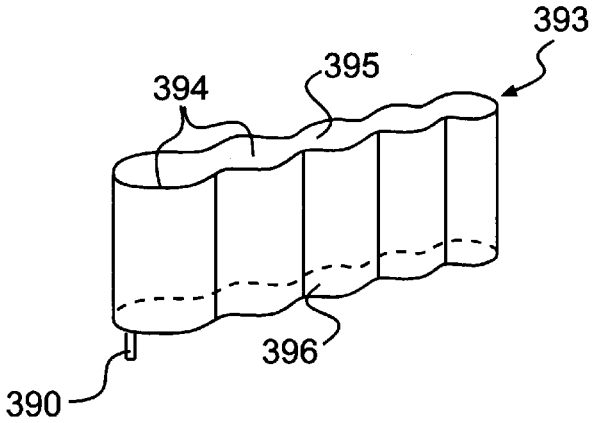
FIG. 17C is a perspective view of another embodiment of a serving device of the present invention.

The exercise system of the present invention can also include means for serving the game element onto the playing area. The serving means can be removably attached to the frame. FIGS. 17A–17D illustrate a few exemplary serving devices for use with the exercise game. FIG. 17A illustrates a serving device 93 in the form of an open chute having side pieces 94 affixed to rectangular end pieces 95. The side pieces 94 and end pieces 95 form open top 96 and bottom slot 97. The side pieces 94 and end pieces 95 can, for example, be opaque, translucent, or transparent. FIG. 17B depicts a serving device 293 comprising side pieces 294 attached to truncated triangular end pieces 295. The side pieces 294 and end pieces 295 form an open top 296 that narrows to a bottom slot 297. The side pieces 294 and end pieces 295 can, for example, be opaque, translucent, or transparent. FIG. 17C illustrates a serving device 393 having curvilinear faces 394. The curvilinear faces form curvilinear top hole 395 and bottom hole 396.

The serving devices can incorporate obstacles in the chute area to divert a playing piece in different directions upon exiting the bottom slot of the serving device. Although the serving device should preferably be located above the central area of a playing surface, the serving device can be positioned anywhere the players choose. The serving devices can be attached to the frame, the playing surface, or the playing surface side panels by angle pieces 290, multiple pins 90, a single pin 390 inserted into a suitable hole at top of the side panels, or any other suitable connection.

Figure 17D:
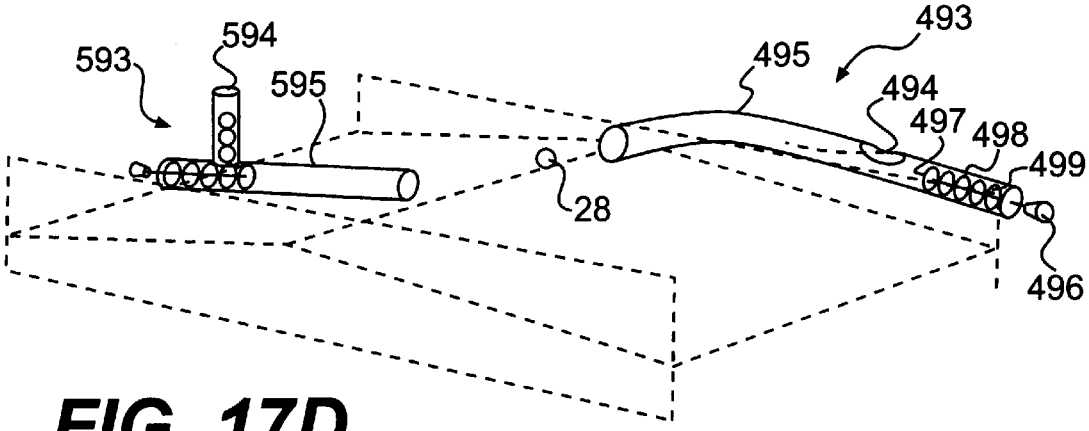
FIG. 17D is a perspective view of another embodiment of a serving device of the present invention.

FIG. 17D depicts two pinball-type serving devices 493, 593. Game element 28 is inserted in hole 494 of curved tube 495. The player pulls back handle 496, which is connected to pushing member 497 by shaft 498, thereby compressing spring 499. When the handle 496 is released, the spring 499 expands, causing pushing member 497 to impel game element 28 through the curved tube 495 and across the playing surface. Serving device 593 is a pinball-type serving device similar to serving device 493, but has a straight tube 595 and a game element magazine feeder 594, which can be automatic. The serving device 593 can be aimed by a serving player to initiate play.

The exercise system of the present invention can also include means for registering scores as the game element is moved through selected portions of the playing area, the registering means being removably attached to the frame For example, FIG. 13 illustrates a target display device 98 having targets 99. The targets 99 are spring loaded in such a way that when hit by a game element, the target 99 will retract denoting a point score. The target display device 98 can, for example, be supported by the playing area sides.

Figure 2:
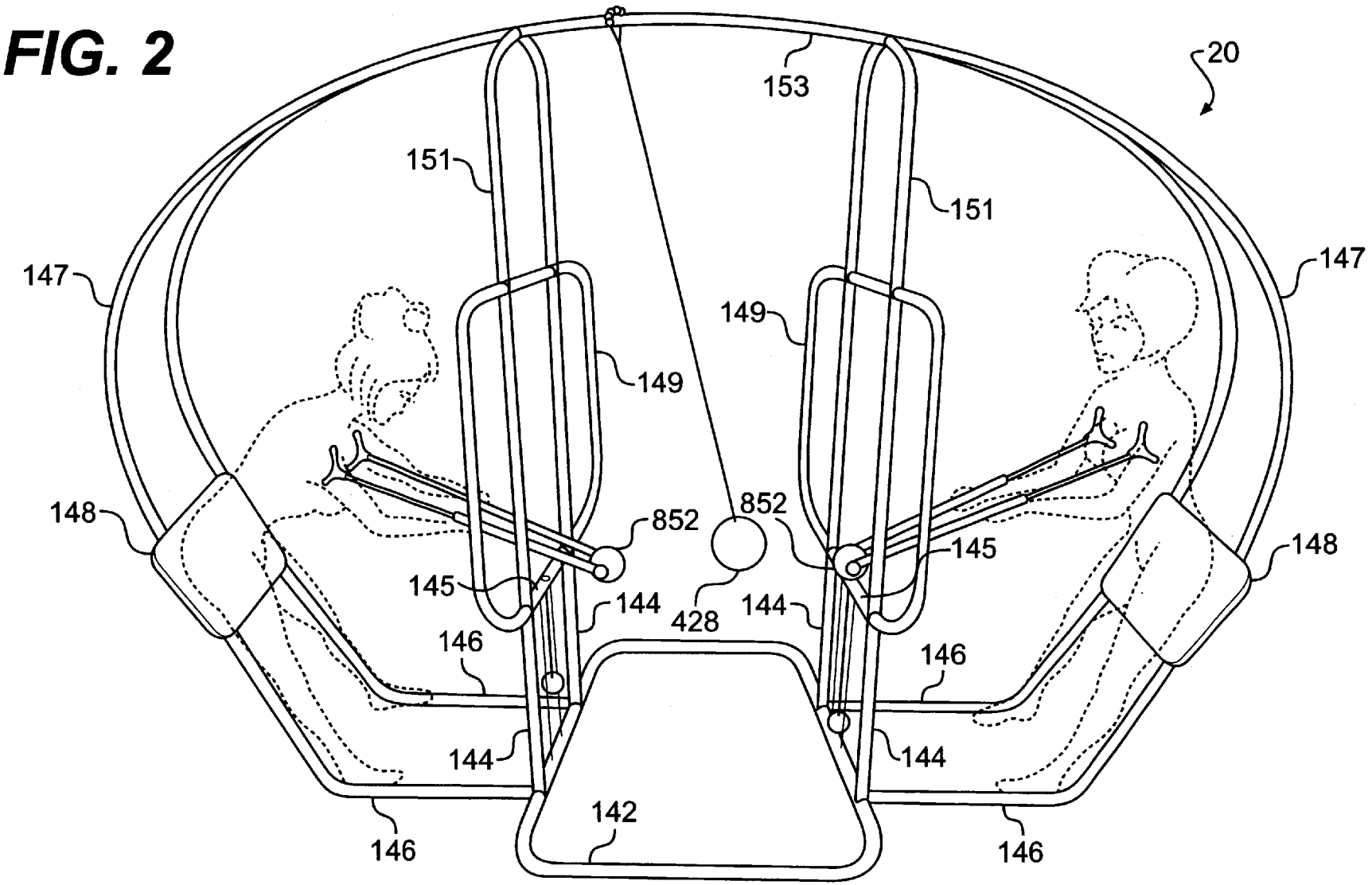
FIG. 2 is a perspective view of another embodiment of the present invention.

FIG. 2 depicts another embodiment of the exercise game system 120 of the present invention. Floor base member 142 locates and supports support legs 144, which support legs 144 support motion resistance system support bars 145 and goal defining members 149. The support legs 144 can be adjustable by telescopic or other conventional means to adjust the height of the motion resistance system support bars 145 and goal defining members 149. Seat support members 146 extend horizontally from floor base member 142 and then bend upwards to provide a support for seat rests 148 at a position relative to the playing area. The position of the seat rests 148 can be adjusted by telescoping or other conventional; adjustment means. Foot rests (not shown) can be attached to seat support members 146 to provide support for the players' feet. Seat rests 148 are preferably removable and interchangeable by conventional means to accommodate a variety of players anatomical dimensions and physical conditions. Upper frame members 147 extend upward from seat support members 146 toward the overhead center of the playing area and connect with upper goal defining members 151. The upper goal defining members 151 are connected to game element support 153. Upper frame members 147 can be adjustable by conventional means to accommodate changes or adjustments in goal frame support legs 144 and seat support members 146. The playing area can feature numerous variations, such as the inclusion of obstacles, additional goal areas, rebound areas on the sides, above, or below the playing area. Striking member 852 is connected to a motion resistance system. The motion resistance system is supported at the top by support bar 145 and at the bottom by floor base member 142. The motion resistance system can be adjustable to provide varying degrees of resistance to the movement of the striking member 852. The resistance can be varied relative to the direction of movement, speed of movement, and/or the distance of movement by use of, for example, the devices depicted in FIG. 7A–7E.

FIGS. 3A–3F illustrate yet another embodiment of the exercise game system 920 of the present invention. The embodiment disclosed in FIGS. 3A–3F is collapsible to within a rectangular cubic volume and also includes means for rolling the exercise game system while in the collapsed state.

Figure 3A:
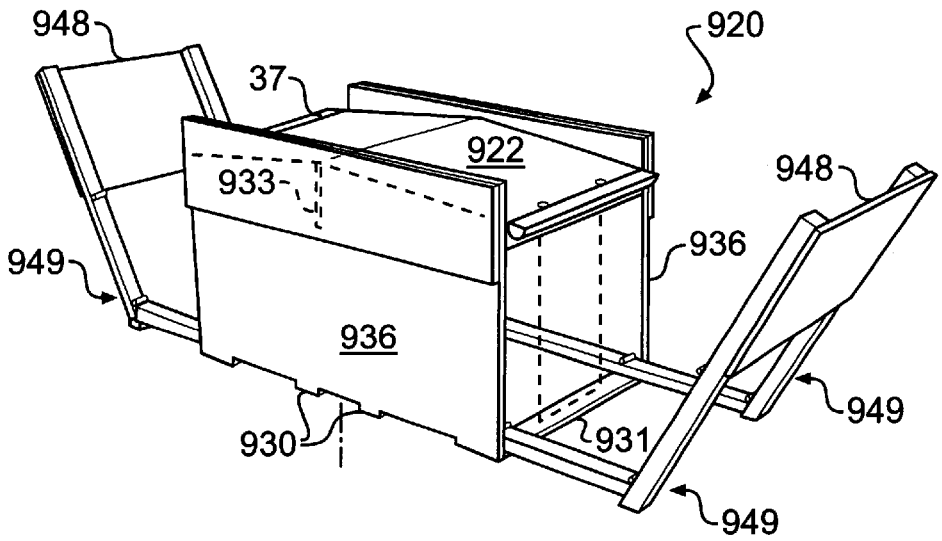
FIG. 3A is a perspective view of yet another embodiment of the present invention in an open position.

FIG. 3A depicts a frame comprising side surface 936, base cross members 930, lower motion resistance device support brace 931, and center brace member 933. The frame establishes a hollow boxlike shape support playing surface 922. The height of playing surface 922 can be adjusted by conventional means. Seat rests 938 are supported by hinged seat support frame assemblies 949.

Figure 3B:
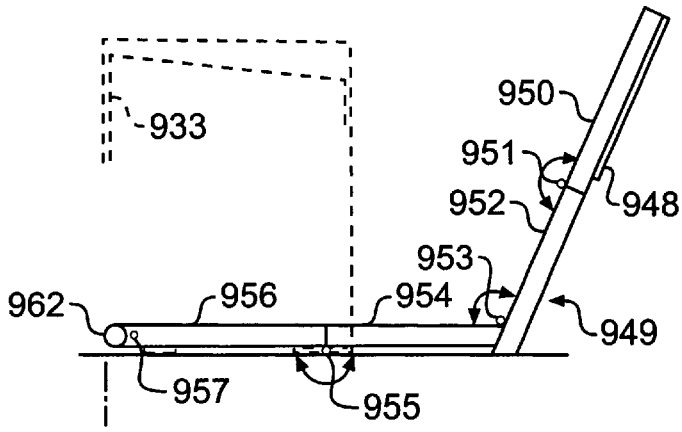
FIG. 3B is a side view of the seat and seat support elements of the embodiment shown in FIG. 3A in an open position.

FIG. 3B illustrates seat rest 948 in its open or playing position and supported by seat support assembly 949. The seat support assembly 949 comprises upper seat brace 950, hinge 951, lower seat brace 952, hinge 953, horizontal seat brace extension member 954, hinge 955, inner horizontal seat brace extension member 956, and pivot point 957.

Figure 3C:
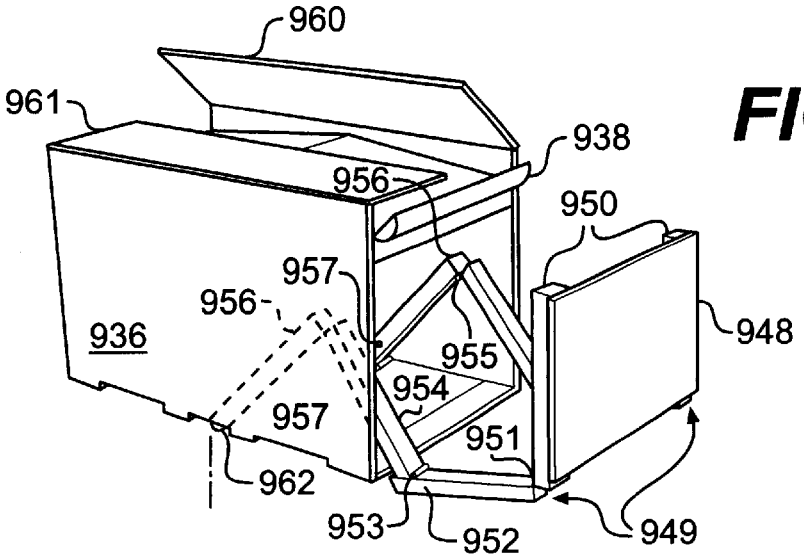
FIG. 3C is a perspective view of the embodiment shown in FIG. 3A in a partially closed position.
Figure 3D:
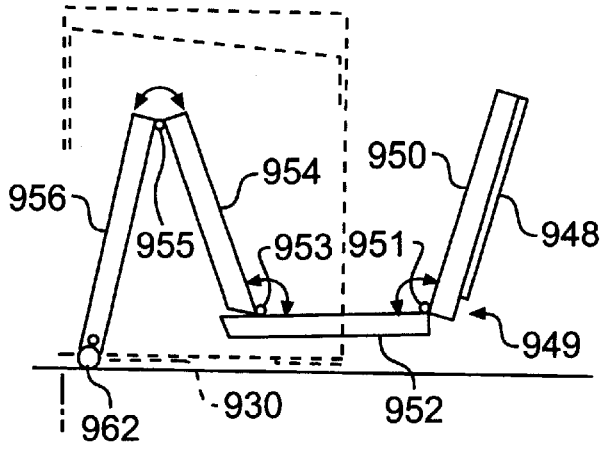
FIG. 3D is a side view of the seat and seat support elements of the embodiment shown in FIG. 3A in a partially closed position.

FIG. 3C depicts a perspective view of the collapsing or opening action of seat rests 948 and support assembly 949 relative to the cube, and the opening or closing of top covers 960 and 961 and gutter 938. FIG. 3D shows the closing or collapsing action of the seat supports assemblies 949 by bending hinges 951, 953, 955, and pivoting members 956 around point 957, thereby causing the downward rotation of wheels 962 to bring the wheels 962 into contact with the floor and causing the frame to rise above the floor level. When the exercise game system is opened, the action is reversed and the wheels 962 retract to lower the frame onto the floor.

Figure 3E:
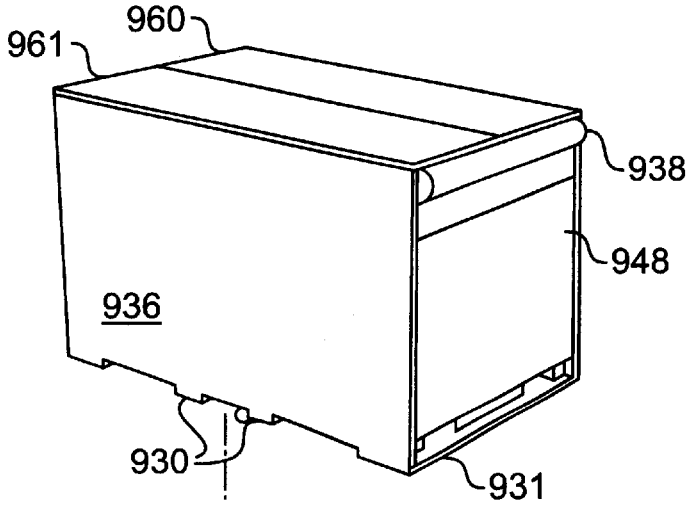
FIG. 3E is a perspective view of the embodiment shown in FIG. 3A in a fully closed position.

FIG. 3E shows the rectilinear frame in its collapsed or closed position with top covers 960, 961 covering playing surface 922, gutter 938 in the vertical stored position, and the back of seat rests 948 collapsed inward to form a partial end of the rectilinear cube.

Figure 3F:
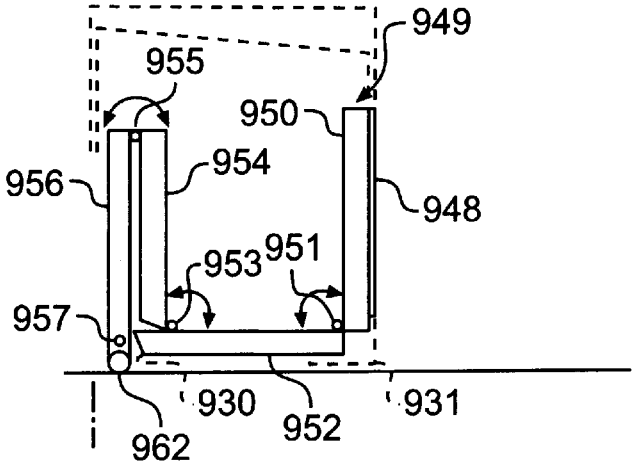
FIG. 3F is a side view of the seat and seat support elements of the embodiment shown in FIG. 3A in a fully closed position.

FIG. 3F illustrates seat support assembly 949 collapsed within side surfaces 936. Wheel 962 is rotated around point 957 in order to fully raise the cube so as to provide rolling mobility of the exercise game system. The seat rests 948, top covers 960, 961, and gutters 938 can be secured in the closed or open position by conventional means. The opening and closing of the assembly can be assisted by, for example, springs, guides, levers, pulleys, electromechanical devices, or hydraulic devices.

The game can be played with action such as, but not limited to, the following. Two players are positioned on opposing sides of the playing area. The supporting means is adjusted to accommodate the anatomical dimensions of the players and each player is positioned in a stance such that their buttocks are resting against the seat rest and their feet are positioned on the foot rests, if desired. Each player grasps two manipulating devices and rests the second end of one manipulating device against their right shoulder and the second end of the other manipulating device against their left shoulder. The shafts of the manipulating devices are grasped by the players' hands at the gripping portions. The first ends of the manipulating devices are manipulated by the player to engage the striking member and the protruding portions. Alternatively, the striking member or a handle device on the striking member can be directly grasped by the player.

Play can be initiated by serving the game element into the field of play by: a mechanical device; using the manipulating devices; a hand of a player; or a third party. A player manipulates the striking member in order to strike the game element in such a manner that the game element bypasses the defending player's striking member or falls into a pocket or strikes a bumper device or a score registering device, thereby scoring a point.

In the embodiment shown in FIG 1, a player drives the game element up the inclined surface of the playing area, across the ridge, and down the side toward the opposing player. The opposing player in a like manner grasps and manipulates his manipulating devices to move his striking member in order to block, strike, push, hit, or drive the game element toward the first player. In the embodiment shown in FIG. 2, the striking member is used to impel the game element toward a goal area or score registering device in the playing area, as there is not playing surface. In both embodiments, movement of the striking member by the player is resisted by the motion resistance system. Therefore, the bending and twisting motion of the player necessary to manipulate the striking member results in exercise of the waist, chest, back, arm and shoulder muscles. Grasping the striking member with the manipulating devices or directly grasping the striking member results in exercising of various hand, arm, shoulder and chest muscles, depending on the action and manner of manipulation. One player can be handicapped relative to the other by increasing the resistance to motion of the striking member of the stronger or more expert player by increasing the resistance of their motion resistance system.

Figure 18:
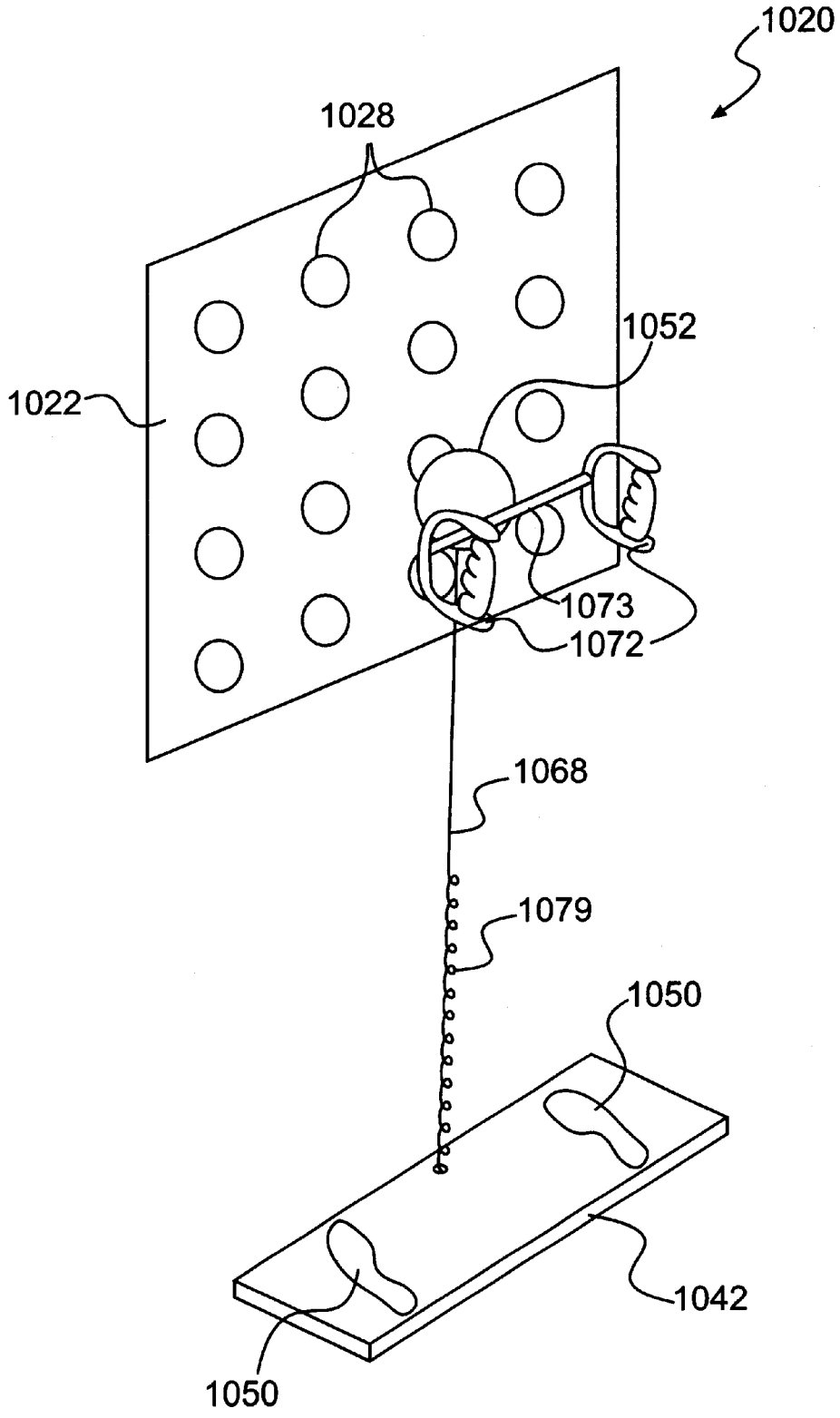
FIG. 18 is a perspective view of another embodiment of the present invention.

FIG. 18 depicts yet another embodiment of the exercise game system 1020 of the present invention. The embodiment shown in FIG. 18 includes a striking member 1052 connected to handles 1072 by a cross member 1073. The handles 1072 are positioned on opposite sides of the cross member 1073. Movement of the striking member 1052 is resisted by a motion resistance system including an elastic member 1079 and flexible line 1068. The elastic member is connected to the striking member 1052 by the flexible line 1068 and is also connected to a floor base frame 1042.

Fixed or movable game elements or targets 1028 are positioned on a playing surface 1022. Although a plurality of game elements 1028 are shown, the invention can also be practiced with only a single game element.

In a preferred manner of using the embodiment of the invention shown in FIG. 18, the person stands on the floor base frame 1042, places their feet on foot rests 1050, grasps handles 1072, and manipulates the striking member 1052 to engage the game elements 1028. In order to move the striking member 1052, the person must overcome the resistance to the movement of the striking member 1052 created by the resistance system. Movement of the striking member 1052 primarily exercises the muscles of the arms, hands, shoulders, and chest, and to a lesser extent, exercises muscles of the legs, abdomen, and torso. Scoring can be measured by, for example, registering the force of impact, speed of impact, or pattern of impact as the striking member 1052 engages the game elements 1028.

In view of the numerous attachments and alternatives described herein, it is apparent that a variety of games can be played between two contestants or by an individual using the apparatus of the present invention. The apparatus can also be used to provide exercise to an individual with or without the use of a game element. An individual can move the striking member in the playing area against the resistance of the motion resistance system in order to exercise their muscles. In addition, the apparatus can be used to provide exercise to an individual while using a game element. For example, a backstop can be positioned at a location on the playing area which will rebound the game element off of the backstop. Movement of the striking member by the player to engage the game element results in the performance of exercise.

The apparatus described above has numerous advantages, including, but not limited to, the following. The overall dimensions of the game apparatus are relatively sized such that it can be conveniently located and played indoors as well as outdoors. The frame can be collapsible, or capable of being disassembled, in such a way as to fold into the cubic volume beneath or above the playing area or beside the playing area and hence provide a compact unit that can be conveniently stored.

It will be apparent to those skilled in the art that various modifications and variations can be made in the apparatus of the present invention and in construction of this apparatus without departing from the scope or spirit of the invention. By means of example only, the following elements can be varied:

the manner of scoring points in the game;

the shape, size and weight of the manipulating devices;

the shape and size of the playing area;

the shape and size of any deformation, objects, or obtrusions on or to the field of play;

the shape, weight, size, and rebound percentage of the game element;

the shape, weight, and size of the striking member;

the shape, weight, and size of the weights; and the number of game elements and striking devices.

While certain, preferred embodiments have been shown and described, other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An exercise system for one or more persons comprising:

at least one movable game element;

at least one striking means that is movable by a person towards the game element, the movement of said striking means being resisted by inherent resistance; and an exercise-inducing resistance system including means for providing an additional second and substantial exercise inducing resistance to movement of the striking means as the striking means is moved by the person towards the game element while said game element is moving, whereby the person performs exercise by overcoming the resistance of the resistance system while moving the striking means to engage the moving game element.

2. The exercise system of claim 1, further comprising a scoring device.

3. The exercise system of claim 2, wherein said scoring device registers the force required to move the striking means towards the game element.

4. The exercise system of claim 3, wherein said scoring device registers the speed of the striking means as it moves towards the game element.

5. The exercise system of claim 1, wherein the person stands on a surface and the striking means is vertically movable away from the surface on which the player is standing toward the moving game element located in a vertical plane substantially above the surface.

6. The exercise system of claim 5, wherein said resistance system is attached at one end to the surface on which the player is standing and on the other end to the striking means.

7. The exercising system of claim 6, wherein said striking means is connected to at least one handle for a user's hand.

8. The exercising system of claim 6, wherein said striking means includes an elongated flat surface for striking the game element.

9. An exercise system of claim 1, wherein said game element is attached to a tether.

10. The exercise system of claim 9, wherein said tether is elastic.

11. The exercise system of claim 1, wherein said game element is attached to a pivoting pendulum.

12. The exercise system of claim 1, wherein said game element is attached to a pivoting pendulum.

13. The exercise system of claim 1, wherein said game element moves along a playing surface, and said striking means moves along the playing surface to engage the game element.

14. The exercise system of claim 13, wherein said playing surface is inclined.

15. The exercise system of claim 1, wherein said exercise system includes two striking means configured so that a player can cause one of the striking means to strike the game element to cause said game element to move in the direction of another player.

16. An exercise system for two or more persons comprising:

at least one game element;

at least two striking means, each striking means being movable by a person toward the game element, the movement of said striking means being resisted by inherent resistance; and an exercise-inducing resistance system including means for providing an additional second and substantial exercise inducing resistance to movement of the striking means as each striking means is moved by a person towards the game element, whereby a person performs exercise by overcoming the resistance of the resistance system while moving the striking means to engage the moving game element.

17. The exercise system of claim 16, further comprising a scoring device.

18. The exercise system of claim 17, wherein said scoring device registers the force required to move each of the striking means towards the game element.

19. The exercise system of claim 18, wherein said scoring device registers the speed of each striking means as it moves toward the game element.

20. The exercise system of claim 16, wherein said striking means includes an elongated flat surface for striking the game element.

21. The exercise system of claim 16, wherein said game element is attached to a tether.

22. The exercise system of claim 21, wherein said tether is elastic.

23. The exercise system of claim 16, wherein said game element is attached to a pivoting pendulum.

24. The exercise system of claim 16, wherein said game element moves along a playing surface, and said striking means slide on the playing surface to engage the game element.

25. The exercise system of claim 24, wherein said playing surface is inclined on opposing sides of a central ridge.

26. An exercise system for one or more persons comprising:

at least one game element;

two or more striking means, each being movable by a person toward a game element, the movement of each striking means being resisted by inherent resistance; and at least one exercise inducing resistance system including means for providing additional exercise inducing resistance to movement of said striking means as each striking means is moved by a person toward a game element, whereby a person performs exercise by overcoming the resistance of said resistance system while moving a striking means toward said game element.

27. The exercise system of claim 26, wherein said game element is moving as the person moves a striking means toward said game element.

28. The exercise system of claim 26, wherein the motion of said striking means is in a linear direction away from the person moving the striking means.

29. The exercise system of claim 26, wherein the movement of said striking means is not directed in an arch pathway.

30. The exercise system of claim 26, wherein the movement of said striking means toward said game element is not guided in a predetermined pathway.

31. An exercise system for one or more persons comprising:

at least one game element;

at least one striking means that is movable by a person toward a game element, the movement of said striking means being resisted by inherent resistance; and at least one exercise inducing resistance system including means for providing an additional exercise inducing resistance to movement of a striking means as said striking means is moved by a person toward a game element, whereby a person performs exercise by overcoming the resistance of a resistance system while moving a striking means toward a game element.

32. The exercise system of claim 31, wherein the movement of said striking means is not guided toward a predetermined pathway, said resistance system, or any apparatus connecting said striking means with said resistance system.

33. The exercise system of claim 31, wherein the striking means engages the game element in a first location and subsequently engages the game element in a second location different than the first location.

34. The exercise system of claim 31, wherein the game element moves in a reciprocating manner.

35. The exercise system of claim 31, wherein the game element is not intended to move in a predetermined pathway.

36. The exercise system of claim 1, wherein the means for providing an additional second and substantial exercise inducing resistance to movement of the striking means as the striking means is moved by the person towards the game element while said game element is moving provides resistance to movement in the direction away from the player.

37. The exercise system of claim 1, wherein the striking means is located between the player and the game element.

38. The exercise system of claim 16, wherein the game element is located between two striking means.

39. An exercise system comprising:

at least one movable game element;

at least one striking member that is movable by a person toward the game element, the movement of said striking member being resisted by inherent resistance;

an exercise-inducing resistance system including means for providing an additional second and substantial exercise inducing resistance to movement of the striking member as the striking member is moved by the person towards the game element while said game element is moving, whereby the person performs exercise by overcoming the resistance of the resistance system while moving the striking member to engage the moving game element; and a scoring device that registers the force required to move the striking member towards the game element.

40. The exercise system of claim 39 wherein said scoring device registers the speed of the striking members as it moves toward the game element.

41. An exercise system for two or more persons comprising:

at least one game element;

at least two striking means, each striking member being movable by a person toward the game element, the movement of said striking members being resisted by inherent resistance; and an exercise-inducing resistance system including means for providing an additional second and substantial exercise inducing resistance to movement of the striking members as each striking member is moved by a person towards the game element, whereby a person performs exercise by overcoming the resistance of the resistance system while moving the striking members to engage the moving game element; and a scoring device that registers the force required to move each of the striking members towards the game element.

42. The exercise system of claim 41, wherein said scoring device registers the speed of each striking member as it moves toward the game element.

43. The exercise system of claim 31, wherein said game element is moving as the person moves a striking means toward said game element.

44. The exercise system of claim 31, further comprising a scoring device.

45. The exercise system of claim 44, wherein said scoring device registers the force required to move the striking means towards the game element.

46. The exercise system of claim 44, wherein said scoring device registers the speed of the striking means as it moves towards the game element.

* * * * *

UNITED STATES PATENT AND TRADEMARK OFFICE

CERTIFICATE OF CORRECTION

PATENT NO. : 6,406,408 B1
DATED : June 18, 2002
INVENTOR(S) : Bill Price, II

It is certified that error appears in the above-identified patent and that said Letters Patent is hereby corrected as shown below:

Title page,
Item [57], ABSTRACT,
Line 7, “exchange” should read -- engage --.

Column 15,
Line 9, “movable” should read -- moveable --.

Column 17,
Line 31, “movable” should read -- moveable --.

Column 18,
Line 10, “means” should read -- members --.

Signed and Sealed this

Third Day of December, 2002

JAMES E. ROGAN
*Director of the United States Patent and Trademark Office*